US008061313B2

(12) United States Patent
Takahashi et al.

(10) Patent No.: US 8,061,313 B2
(45) Date of Patent: Nov. 22, 2011

(54) VARIABLE VALVE DEVICE FOR ENGINE

(75) Inventors: Toshihiko Takahashi, Shizuoka (JP); Kazuya Koike, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 276 days.

(21) Appl. No.: 12/372,793

(22) Filed: Feb. 18, 2009

(65) Prior Publication Data

US 2009/0205597 A1 Aug. 20, 2009

(30) Foreign Application Priority Data

Feb. 19, 2008 (JP) ..... 2008-037657

(51) Int. Cl.
*F01L 1/34* (2006.01)

(52) U.S. Cl. ..... 123/90.16; 123/90.39

(58) Field of Classification Search ..... 123/90.16, 123/90.39; 74/569
See application file for complete search history.

(56) References Cited

U.S. PATENT DOCUMENTS

| | | | |
|---|---|---|---|
| 4,353,334 A | 10/1982 | Neitz | |
| 4,499,870 A | 2/1985 | Aoyama | |
| 5,207,193 A | 5/1993 | Sugimoto et al. | |
| 5,515,820 A | 5/1996 | Sugimoto et al. | |
| 6,092,497 A | 7/2000 | Preston et al. | |
| 6,481,398 B2 | 11/2002 | Uchiyama | |
| 6,953,012 B2 * | 10/2005 | Hirano | 123/90.16 |
| 7,156,059 B2 | 1/2007 | Yokoyama et al. | |

FOREIGN PATENT DOCUMENTS

| | | |
|---|---|---|
| DE | 27 37 601 A1 | 3/1979 |
| EP | 0 258 061 A1 | 3/1988 |
| EP | 0 703 357 A2 | 3/1996 |
| EP | 1 247 945 A2 | 10/2002 |
| JP | 2000-213320 A | 8/2000 |
| JP | 2001-41017 A | 2/2001 |
| JP | 2002-188510 A | 7/2002 |
| JP | 2002-303109 A | 10/2002 |
| JP | 2005-146955 A | 6/2005 |

OTHER PUBLICATIONS

Official Communication issued in corresponding European Patent Application No. 09002268.2, mailed on Aug. 18, 2009.

* cited by examiner

*Primary Examiner* — Zelalem Eshete
(74) *Attorney, Agent, or Firm* — Keating & Bennett, LLP

(57) ABSTRACT

A variable valve device is constructed to prevent inclination of a sliding surface of a high speed rocker arm. In an engagement surface where a connecting pin and the engagement portion of a high speed rocker arm are in contact, the center of the width of the surface in the direction of the cam shaft is provided closer to the high speed rocker arm than the center of the width in the direction of the camshaft of a cam contact surface where the high speed cam and the sliding surface of the high speed rocker arm are in contact. The low speed rocker arm includes a cam receiver and a connecting portion. The width of the connecting portion is larger than that of the cam receiver. The side surface of the connecting portion projects beyond the side surface of the cam receiver. The high speed rocker arm includes a cam receiver and a connecting portion. The side surface of the connecting portion and the side surface of the connecting portion are provided in the cam contact surface and within the width of the surface in the direction of the camshaft.

5 Claims, 17 Drawing Sheets

VARIABLE VALVE DEVICE FOR ENGINE

BACKGROUND OF THE INVENTION

1. Field of the Invention

The present invention relates to a variable valve device and more specifically to a variable valve device arranged to switch a lift degree of a valve between a high speed state and a low speed state.

2. Description of the Background Art

JP 2002-303109 discloses a speed range selectable valve gear mechanism for an internal combustion engine. In the valve gear mechanism, a camshaft includes low and high cam noses, and a valve supported at a cylinder head is selectively engaged with one of the high and low cam noses, which allows the valve to be opened or closed according to the high and low speed ranges of the internal combustion engine. First and second rocker arms are pivotally supported at the cylinder head. The swinging end of the first rocker arm (for low speed) and the low cam nose are engaged with each other by the cam-linkage, and the swinging end of the second rocker arm (for high speed) and the high cam nose are engaged with each other by the cam-linkage. A columnar engaging member (connecting pin) is supported at the first rocker arm in a reciprocally slidable manner. The engaging member slides and projects from the side of the first rocker arm to the side of the second rocker arm in such a manner that it can advance/withdraw. This allows the first and second rocker arms to be detachably engaged with each other. The cylinder head is provided with a hydraulic actuator that applies an external force upon the engaging member while resisting against the energizing force of a disengaging spring. The actuator includes a cylinder hole (hydraulic cylinder) formed at the cylinder head and a piston (hydraulic piston) slidably inserted into the cylinder hole. The cylinder hole is in communication with the hydraulic pump through an oil passage. The oil passage is formed at the cylinder head. A coil-shaped rocker arm spring (lost-motion spring) is provided around a pivotal shaft of the rocker arm and the spring urges the second rocker arm so that the second rocker arm and the high cam nose are engaged with each other by a cam-linkage.

In this way, a through hole is formed at the first rocker arm, and the engaging member is inserted in the hole. A clearance is always provided between the through hole and the engaging member in order to allow the engaging member to slide and allow for working tolerances. More specifically, the diameter of the through hole is made slightly larger than the diameter of the engaging member. Therefore, the second rocker arm is engaged with the engaging member projecting from the through hole of the first rocker arm, and when force is applied in the direction vertical to the axial direction of the engaging member, the engaging member is inclined in the range of the clearance and the sliding surface of the second rocker arm is inclined as well. Consequently, the high cam nose and the sliding surface are not in a line contact state, and a so-called biased contact is caused, which results in the high cam nose and the sliding surface being unequally worn.

SUMMARY OF THE INVENTION

In order to overcome the problems described above, preferred embodiments of the present invention provide a variable valve device that prevents inclination of the sliding surface of a high speed rocker arm.

A variable valve device according to a preferred embodiment of the present invention switches a lift degree of a valve between a low speed state and a high speed state and includes a low speed rocker arm, a connecting pin, an actuator, and a high speed rocker arm. The low speed rocker arm includes a through hole arranged parallel or substantially parallel to a rocker shaft, is swingably supported by the rocker shaft, and swings according to the lower speed cam of a camshaft to push the stem end surface of the valve. The connecting pin is slidably inserted into the through hole. The actuator reciprocates the connecting pin in the through hole. The high speed rocker arm includes an engagement portion that engages with the connecting pin projecting from the through hole, is swingably supported by the rocker shaft, is provided adjacent to the low speed rocker arm, and swings according to a high speed cam of the camshaft. A first center of a width in a direction of the cam shaft of a surface where the connecting pin and the engagement portion are in contact with each other matches a center of a width in a direction of the camshaft of a surface where the high speed cam and the sliding surface of the high speed rocker arm are in contact with each other or is located further than the second center from the valve.

According to a preferred embodiment of the present invention, the high speed rocker arm engages with the connecting pin projecting from the through hole and if the connecting pin is inclined, the high speed rocker arm is less likely to be inclined in the same direction as the connecting pin because the position where the high speed cam pushes the high speed rocker arm matches the position where the high speed rocker arm pushes the connecting pin or is closer to the valve than the position. Consequently, the inclination of the sliding surface of the high speed rocker arm is prevented.

The low speed rocker arm may further include a first cam receiver and a first connecting portion, for example. The first cam receiver has a sliding surface in contact with the low speed cam and a side surface extending perpendicularly or substantially perpendicularly from an end of the sliding surface. The first connecting portion is arranged to be integral with the first cam receiver, has a width wider than that of the first cam receiver, and includes a side surface projecting beyond a side surface of the first cam receiver, and the through hole is defined at the first connecting portion. The high speed rocker arm may further include a second cam receiver and a second connecting portion, for example. The second cam receiver has a sliding surface in contact with the high speed cam and a side surface extending perpendicularly or substantially perpendicularly from an end of the sliding surface and opposed to the side surface of the first cam receiver. The second connecting portion is arranged to be integral with the second cam receiver and has a side surface opposed to the side surface of the first connecting portion, and the engagement portion is defined at the second connecting portion. The side surfaces of the first and second connecting portions are provided in a surface where the high speed cam and the sliding surface of the high speed rocker arm are in contact with each other and within the width of the surface in the direction of the camshaft.

In this way, the width of the first connecting portion of the low speed rocker arm is wider than that of the first cam receiver, and a long through hole is arranged at the first connecting portion, so that the connecting pin is less likely to be inclined if the high speed rocker arm engages with the connecting pin projecting from the through hole. In addition, only the first connecting portion of the low speed rocker arm is projected toward the high speed rocker arm and the high speed rocker arm is recessed to avoid the projected first connecting portion, so that the high speed rocker arm can be swung without colliding against the first connecting portion of the low speed rocker arm.

For example, an axial center of the connecting pin may be provided in a virtual circle centered on an axial center of the rocker shaft and preferably has a radius equal to or substantially equal to a distance from the axial center of the rocker shaft to a closer end of the sliding surface of the high speed rocker arm.

In this way, when the connecting pin is stored inside the through hole, the first connecting portion of the low speed portion is less likely to interfere and the high speed rocker arm can be swung widely.

A variable valve device according to another preferred embodiment of the present invention switches a lift degree of a valve between a low speed state and a high speed state and includes a low speed rocker arm, a connecting pin arranged as an actuator, and a high speed rocker arm. The low speed rocker arm includes a through hole arranged parallel or substantially parallel to a rocker shaft, is swingably supported by the rocker shaft, and swings according to the lower speed cam of a camshaft to push a stem end surface of the valve. The connecting pin is slidably inserted into the through hole. The actuator reciprocates the connecting pin in the through hole. The high rocker arm includes an engagement portion engaged with the connecting pin projecting from the through hole, is swingably supported by the rocker shaft and provided adjacent to the low speed rocker arm, and swings according to the high speed cam of the camshaft. The low speed rocker arm further includes a first cam receiver and a first connecting portion. The first cam receiver has a sliding surface in contact with the low speed cam and a side surface extending perpendicularly or substantially perpendicularly from an end of the sliding surface. The first connecting portion is integral with the first cam receiver, has a width wider than that of the first cam receiver, and includes a side surface projecting beyond the side surface of the first cam receiver, and the through hole is defined at the first connecting portion. The high speed rocker arm further includes a second cam receiver and a second connecting portion. The second cam receiver has a sliding surface in contact with the high speed cam and a side surface extending perpendicularly or substantially perpendicularly from an end of the sliding surface and opposed to the side surface of the first cam receiver. The second connecting portion is integral with the second cam receiver and has a side surface opposed to the side surface of the first connecting portion, and the engagement portion is arranged at the second connecting portion. The side surfaces of the first and second connecting portions are provided in a surface where the high speed cam and the sliding surface of the high speed rocker arm are in contact with each other and within the width of the surface in the direction of the camshaft.

According to another preferred embodiment of the present invention, the width of the first connecting portion of the low speed rocker arm is wider than that of the first cam receiver and a long through hole is defined at the first connecting portion, so that the connecting pin is much less likely to be inclined if the connecting pin projecting from the through hole engages with the high speed rocker arm. In addition, only the first connecting portion of the low speed rocker arm is projected toward the high speed rocker arm and the high speed rocker arm is recessed to avoid the projected first connecting portion, so that the high speed rocker arm can be swung without colliding against the first connecting portion of the low speed rocker arm.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
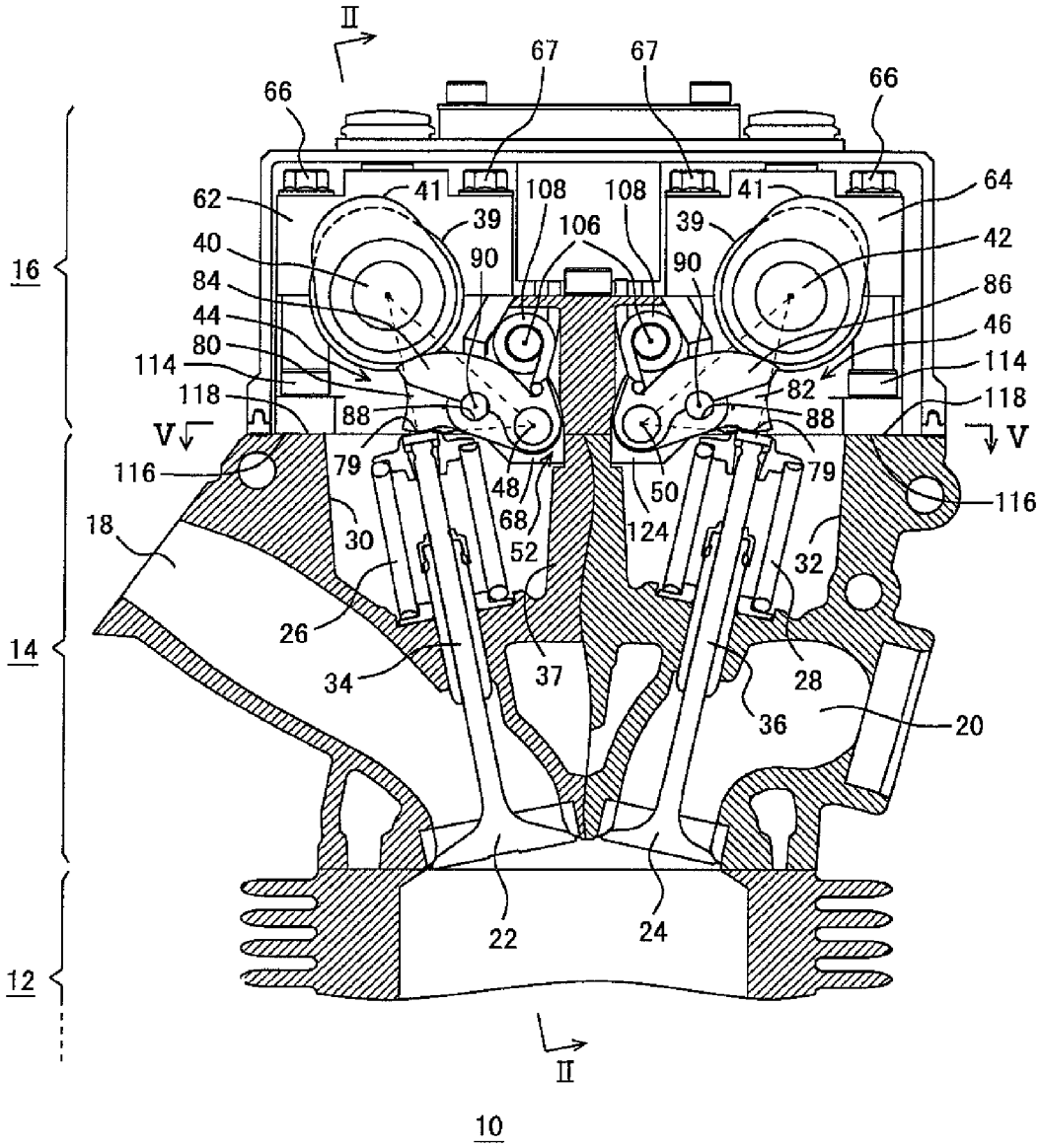
FIG. 1 is a sectional view of an engine including a variable valve device according to a preferred embodiment of the present invention.

Now, preferred embodiments of the present invention will be described in detail with reference to the accompanying drawings, in which the same or corresponding elements are designated by the same reference characters, and their description will not be repeated.

Figure 2:
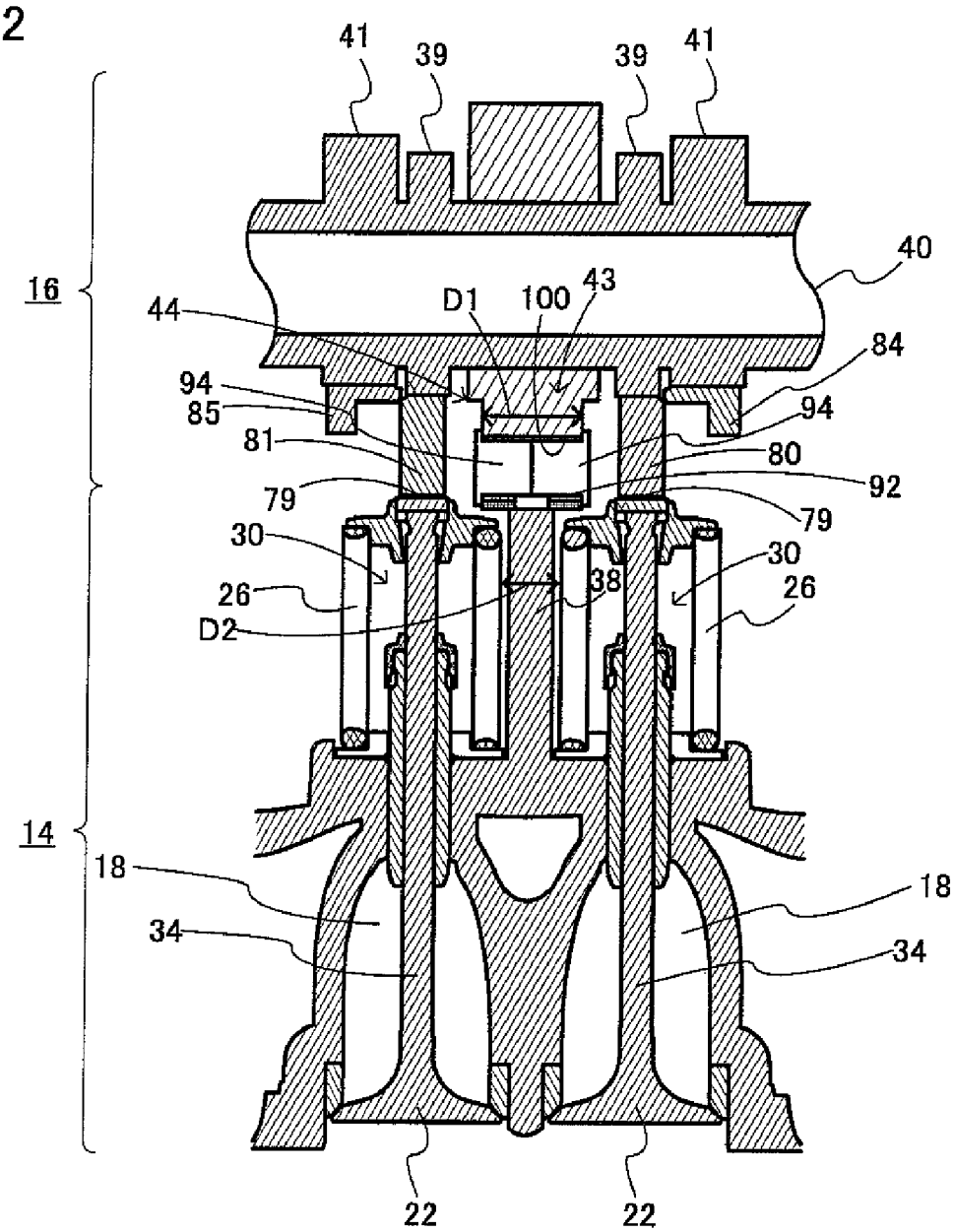
FIG. 2 is a sectional view taken along line II-II in FIG. 1.
Figure 3:
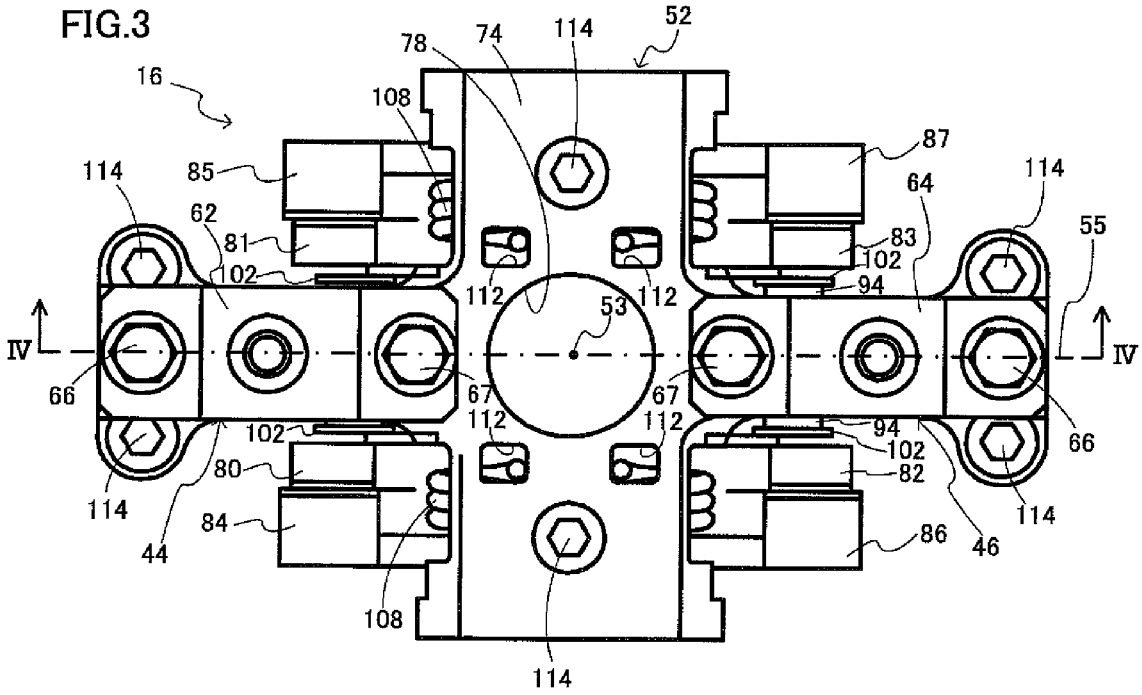
FIG. 3 is a plan view of the cam carrier and various components assembled thereinto shown in FIG. 1.
Figure 4:
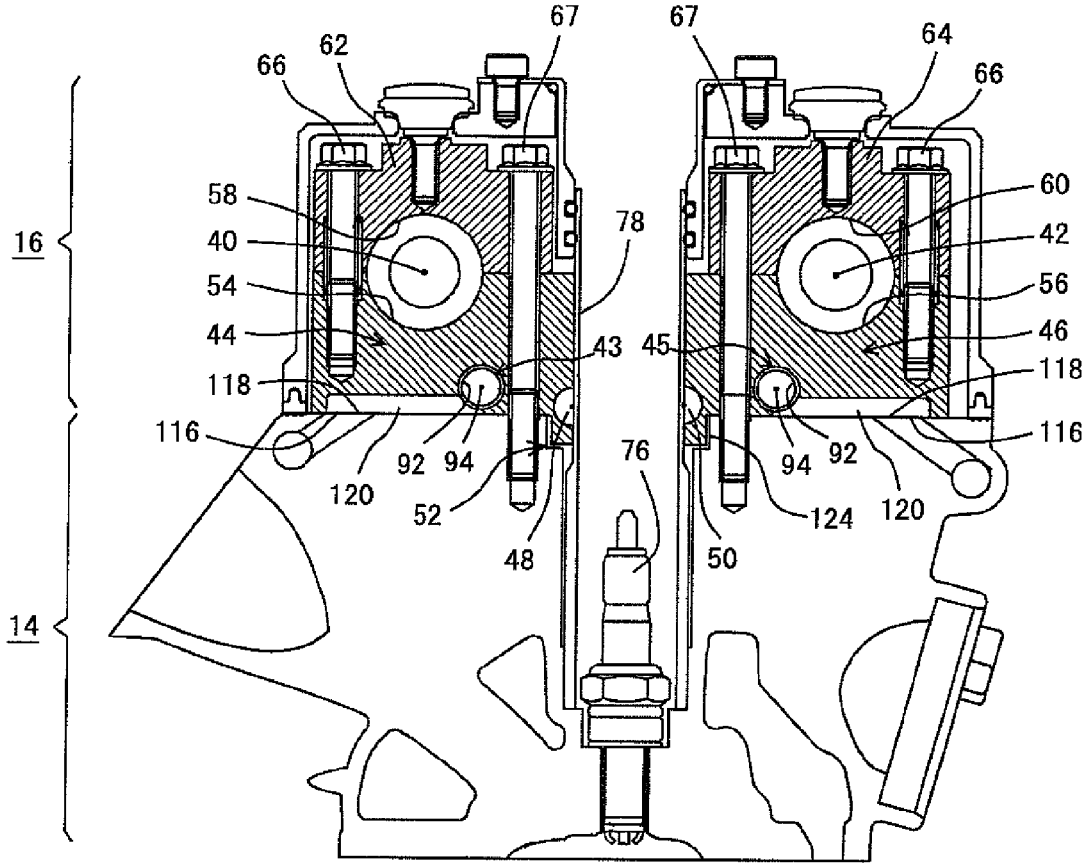
FIG. 4 is a sectional view taken along line IV-IV in FIG. 3.
Figure 5:
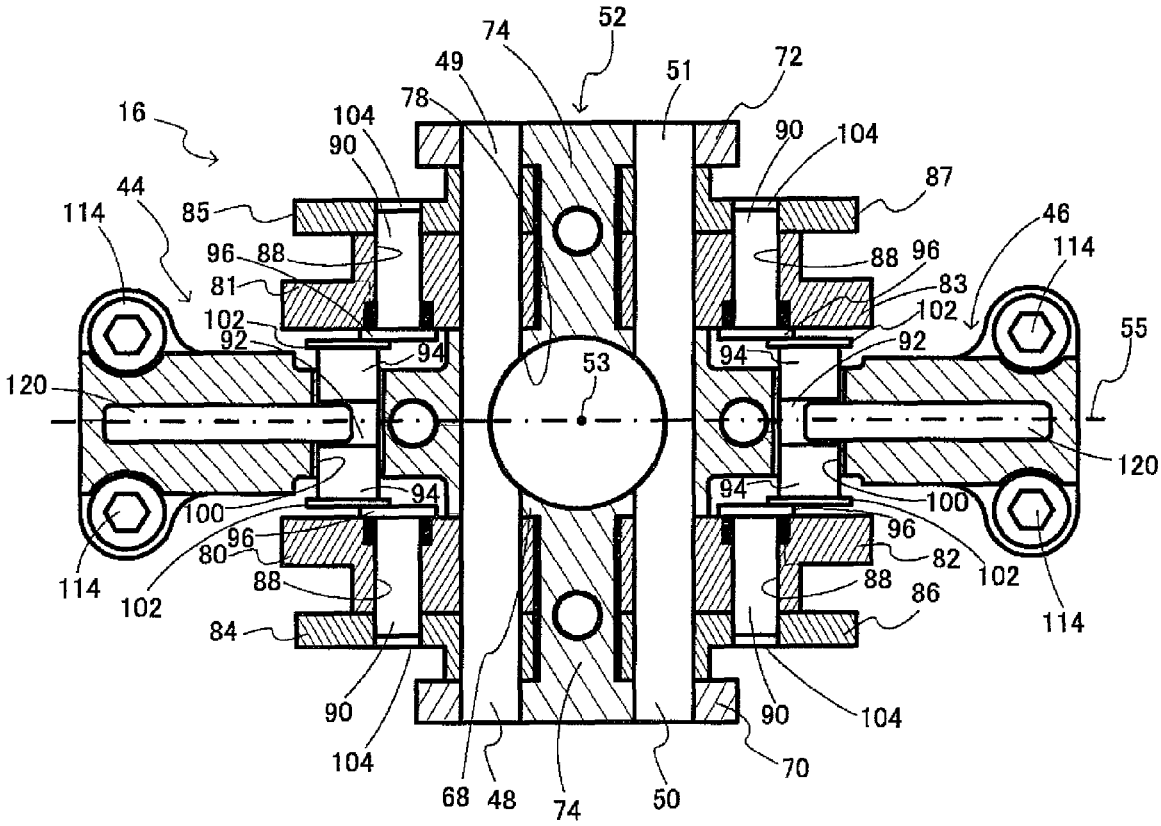
FIG. 5 is a sectional view taken along line V-V in FIG. 1.
Figure 6:
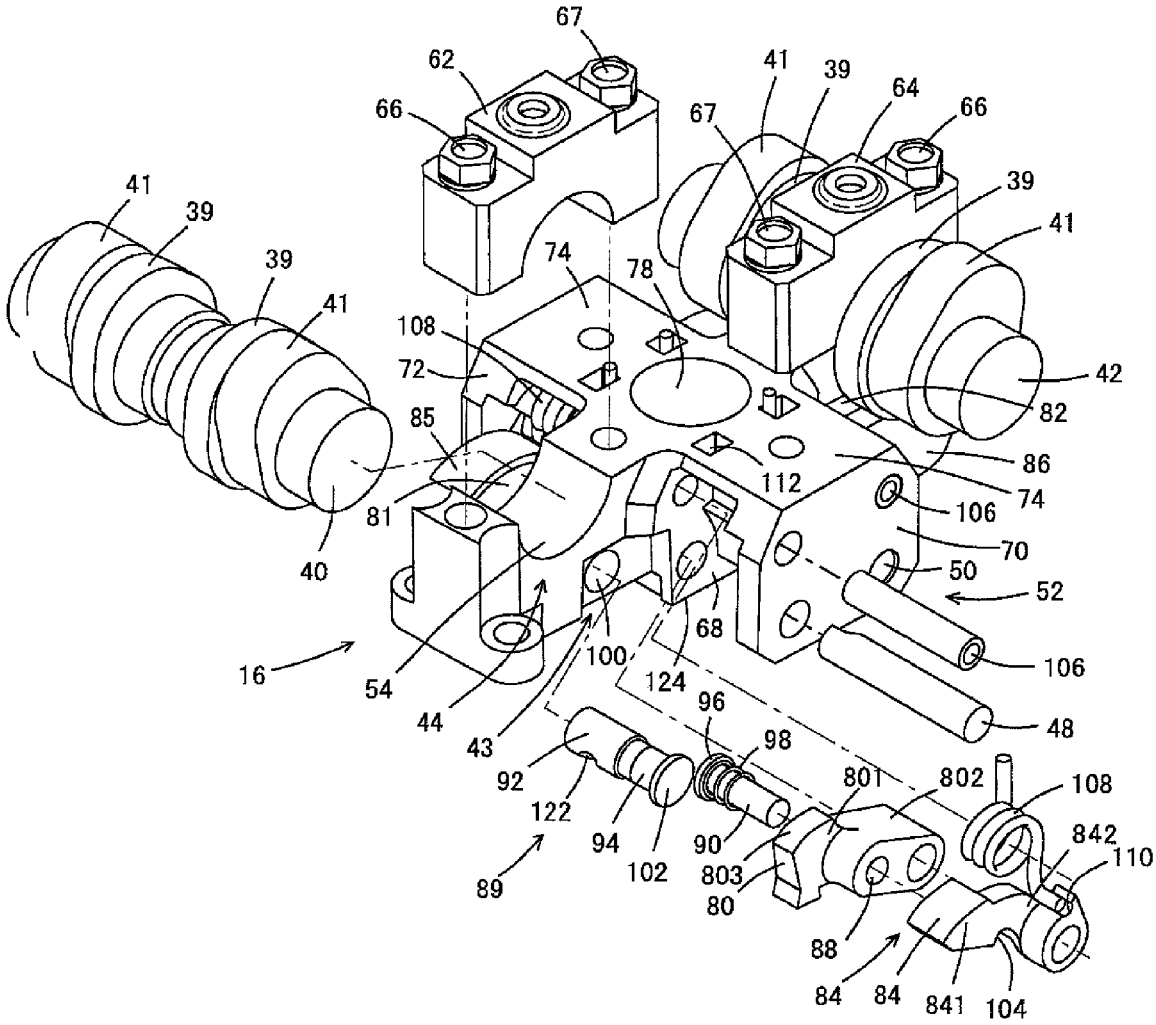
FIG. 6 is an exploded perspective view of the cam carrier and various components assembled thereinto shown in FIG. 1.
Figure 7:
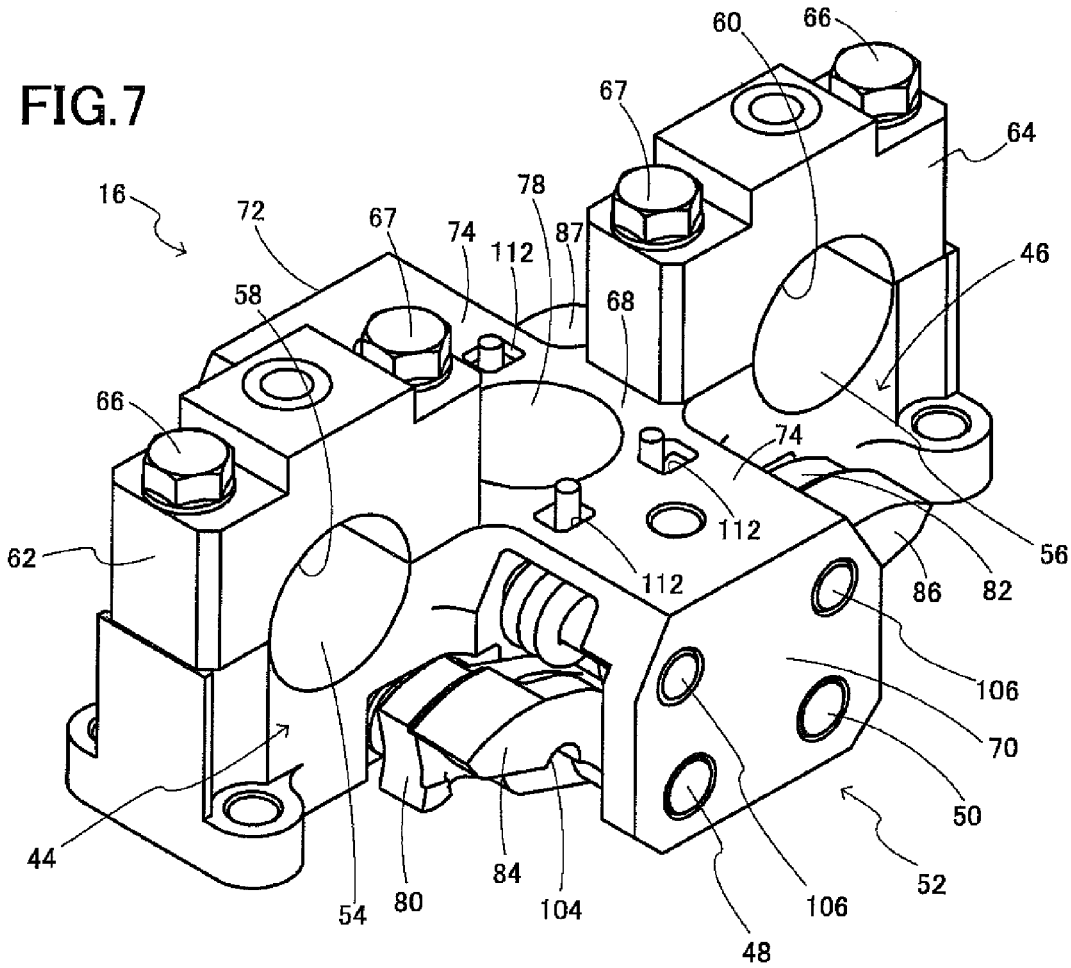
FIG. 7 is a perspective view of the cam carrier and various components assembled thereinto shown in FIG. 6.
Figure 8:
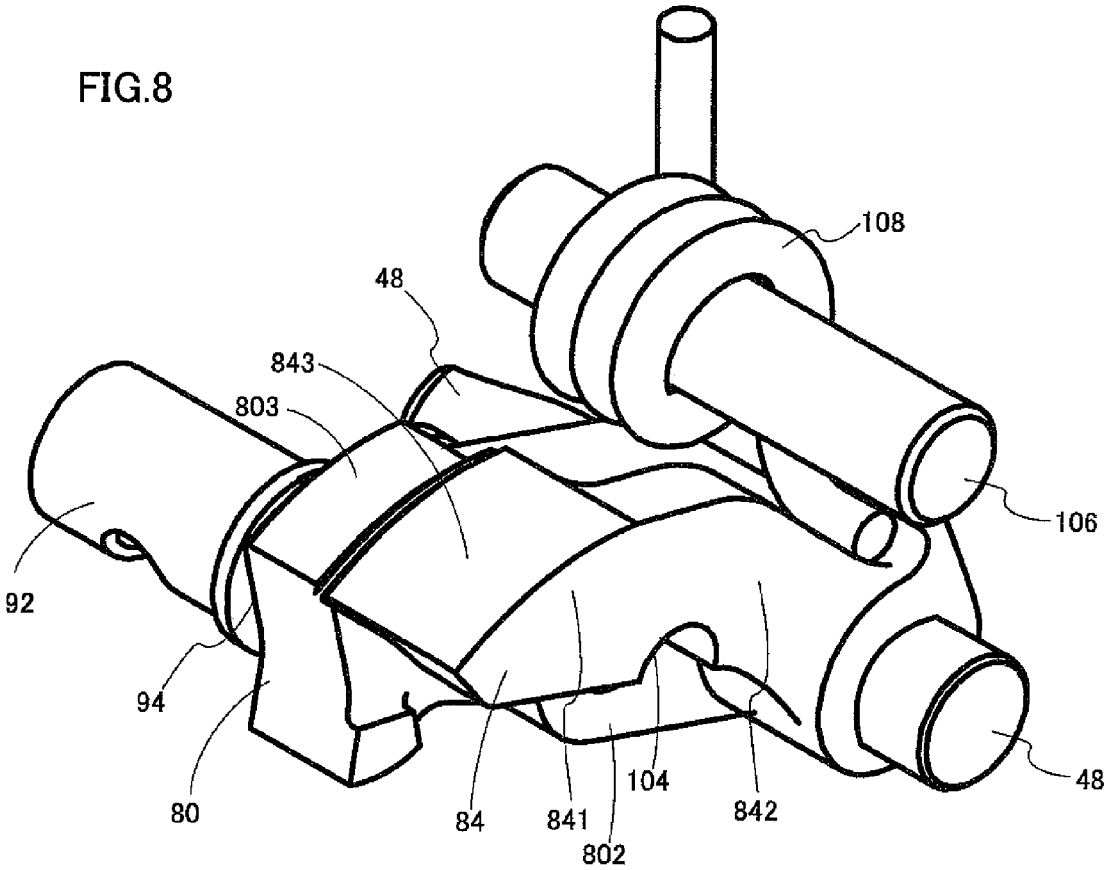
FIG. 8 is a perspective view of the low speed rocker arm, the high speed rocker arm, the rocker shaft, the lost motion spring, the lost motion spring shaft, the connecting pin, the hydraulic piston, and the hydraulic cylinder shown in FIG. 7.

FIG. 1 is a sectional view of an engine according to a preferred embodiment of the present invention. FIG. 2 is a sectional view taken along line II-II in FIG. 1. FIG. 3 is a plan view of the cam carrier and various components assembled thereinto shown in FIG. 1. FIG. 4 is a sectional view taken along line IV-IV in FIG. 3. FIG. 5 is a sectional view taken along line V-V in FIG. 1. FIG. 6 is an exploded perspective view of the cam carrier and various components assembled thereinto shown in FIG. 1. FIG. 7 is a perspective view of the cam carrier and various components assembled thereinto shown in FIG. 6. FIG. 8 is a perspective view of the low speed rocker arm, the high speed rocker arm, the rocker shaft, the lost-motion spring, the lost-motion spring shaft, the connecting pin, the hydraulic piston, and the hydraulic cylinder shown in FIG. 7.

The DOHC (Double Over Head Camshaft) engine according to a preferred embodiment of the present invention includes a variable valve device that switches the lift degrees of the intake and exhaust valves between two stages, i.e., the low speed state and the high speed state. More specifically, with reference to FIGS. 1 and 2, the engine 10 includes a cylinder 12, a cylinder head 14 detachably connected to the cylinder 12, and a cam carrier 16 detachably connected to the cylinder head 14. If, for example, the engine is a four-cylinder engine, four cylinders 12 are arranged in series. In the engine 10, the structure is preferably the same for each cylinder. The preferred embodiments will be described in the following paragraphs with reference to one cylinder.

With reference to FIG. 1, the cylinder head 14 includes an intake port 18, an exhaust port 20, an intake valve 22, an exhaust valve 24, valve springs 26 and 28, and valve spring storing spaces 30 and 32. The engine is a four-valve type engine and two intake valves 22 and two exhaust valves 24 are provided. The valve springs 26 and 28 are wound around the rods 34 and 36 of the intake and exhaust valves 22 and 24 and stored in the valve spring storing spaces 30 and 32, respectively. A partition wall 37 is defined between the valve spring storing space 30 on the intake side and the valve spring storing space 32 on the exhaust side. With reference to FIG. 2, a partition wall 38 is defined between the two valve spring storing spaces 30 on the intake side. While the arrangement is the same as FIG. 2 and therefore is not shown, a partition wall is also defined between the two valve spring storing spaces 32. The partition walls 38 in this example each preferably have the same thickness in any of the locations, but the thickness may be different among the locations.

With reference to FIGS. 1 and 3 to 7, the cam carrier 16 includes cam bearing portions 44 and 46 that rotatably support two camshafts 40 and 42 respectively, a rocker shaft support 52 that supports the rocker shafts 48 to 51, and hydraulic cylinder supports 43 and 45. The cam bearing portions 44 and 46, the rocker shaft support 52 and the hydraulic cylinder supports 43 and 45 are integral. With reference to FIGS. 3 and 5, the cam bearing portions 44 and 46 are aligned on a straight line 55 that passes a bore center (the center of the cylinder 12) 53 in a plane perpendicular or substantially perpendicular to the camshafts 40 and 42. The cam carrier 16 is separately arranged for each of the cylinders. Therefore, in the four-cylinder engine, four such cam carriers 16 are provided. The camshafts 40 and 42 are supported commonly by the four cam carriers 16 that are aligned.

With reference to FIGS. 6 and 7, the cam bearing portions 44 and 46 have semi-circular or substantially semi-circular cuts 54 and 56, respectively, and the camshafts 40 and 42 are laid on the cuts. The camshafts 40 and 42 each have a low speed cam 39 with a small displacement and a high speed cam 41 with a large displacement. Holders 62 and 64 having cuts 58 and 60 symmetrical to the cuts 54 and 56 are attached to the cam bearing portions 44 and 46 by bolts 66 and 67 so that the camshafts 40 and 42 are held between them. In this way, the camshafts 40 and 42 are supported rotatably.

With reference to FIGS. 3 to 7, the rocker shaft support 52 includes a rectangular or substantially rectangular shaped central portion 68, flat end portions 70 and 72, and a connecting portion 74 that connects the central portion 68 and the end portions 70 and 72. The central portion 68 has a through hole 78 through which an ignition plug 76 can be attached/detached to/from the cylinder head 14. The rocker shafts 48 to 51 are attached to the rocker shaft support 52 in parallel or substantially in parallel with the camshafts 40 and 42. Four such rocker shafts 48 to 51 are provided corresponding to the four valves 22 and 24. More specifically, the rocker shafts 48 and 50 bridge between the central portion 68 and the end portion 70. The rocker shafts 49 and 51 bridge between the central portion 68 and the end portion 72. The rocker shafts 48 and 50 are abutted against the rocker shafts 49 and 51, respectively in the central portion 68. In the central portion 68, the rocker shafts 48 to 51 each have a portion cut away in a circular or substantially circular shape along the through hole 78.

With reference to FIGS. 1 to 7, low speed rocker arms 80 to 83 are swingably supported by the rocker shafts 48 to 51. The four low speed rocker arms 80 to 83 are provided corresponding to the four valves 22 and 24. The tip ends of the low speed rocker arms 80 to 83 push the stem end surfaces 79 of the intake and exhaust valves 22 and 24. The low speed rocker arms 80 and 81 swing according to the low speed cam 39 of camshaft 40 on the intake side and thus directly push the intake valve 22. The low speed rocker arms 82 and 83 swing according to the low speed cam 39 of the camshaft 42 on the exhaust side and thus directly push the exhaust valve 24.

High speed rocker arms 84 to 87 are swingably supported by the rocker shafts 48 to 51. Four high speed rocker arms 84 to 87 are provided corresponding to the four valves 22 and 24. The high speed rocker arms 84 to 87 are provided adjacent to the low speed rocker arms 80 to 83, respectively. The high speed rocker arms 84 and 85 swing according to the high speed cam 41 of the camshaft 40 on the intake side. The high speed rocker arms 84 and 85 do not directly push the intake valve 22. The high speed rocker arms 86 and 87 swing according to the high speed cam 41 of the camshaft 42 on the exhaust side. The high speed rocker arms 86 and 87 do not directly push the exhaust valve 24.

With reference to FIGS. 5 and 6, the low speed rocker arms 80 to 83 are provided more on the side of the cam bearing portions 44 and 46 than the high speed rocker arms 84 to 87 and each have a circular or substantially circular through hole 88. The through holes 88 are arranged parallel or substantially parallel to the rocker shafts 48 to 51. A columnar connecting pin 90 is slidably inserted into the through hole 88.

With reference to FIG. 6, the engine 10 is also provided with an actuator 89 that reciprocates the connecting pin 90 in the through hole 88. More specifically, with reference to FIGS. 2, 5, and 6, the actuator 89 includes a cylindrical hydraulic cylinder 92 and a columnar hydraulic piston 94.

The connecting pin 90 has a circular or substantially circular brim 96 at its head. The connecting pin 90 has a spring 98 wound therearound. The connecting pin 90 is slidably inserted into the through hole 88 from its bottom. The connecting pin 90 is therefore urged toward the hydraulic cylinder supports 43 and 45. The connecting pin 90 is longer than the through hole 88. Therefore, when the connecting pin 90 is thoroughly inserted into the through hole 88, the bottom of the connecting pin 90 projects from the opposite end of the through hole 88.

The hydraulic cylinder 92 is each provided in the hydraulic cylinder supports 43 and 45. More specifically, a circular or substantially circular through hole 100 is arranged under each of the cuts 54 and 56 of the cam bearing portions 44 and 46. The hydraulic cylinder 92 is snugly inserted into the through hole 100 and fixed in the hydraulic cylinder supports 43 and 45.

In this example, the through hole 100 of the hydraulic cylinder 92 is pierced in each of the hydraulic cylinder supports 43 and 45 and then the hydraulic cylinder 92 is snugly inserted into the through hole 100, while the through hole 100 itself may be used as a hydraulic cylinder without inserting any element in the through hole 100.

In addition, hydraulic pistons 94 on both sides are inserted into the hydraulic cylinders 92 snugly inserted in the common through holes 100 in this example, but two independent non-penetrating holes having different axial centers may be perforated from both sides of the hydraulic cylinder supports and then the hydraulic cylinders may be inserted into the non-penetrating holes. In this case, the hydraulic cylinders are aligned in the direction perpendicular or substantially perpendicular to the camshaft, so that the width of the hydraulic cylinder supports can further be narrowed.

The hydraulic piston 94 has a circular or substantially circular brim 102 at its head. The hydraulic piston 94 is slidably inserted into the hydraulic cylinder 92 from its bottom. The head (brim 102) of the hydraulic piston 94 is abutted against the head (brim 96) of the connecting pin 90.

In this way, the hydraulic cylinders 92 and the hydraulic pistons 94 are provided under the cam bearing portions 44 and 46, and therefore the actuator 89 can be mounted compactly for a small engine with a narrow inter-valve spring distance. In this example, as shown in FIG. 2, the hydraulic cylinder support 43 is wider than the distance between the two valve springs 26 on the intake side. More specifically, the thickness D1 of the hydraulic cylinder support 43 in the axial direction of the camshaft 40 is larger than the distance D2 between the outer circumferences of the valve springs 26.

With reference to FIGS. 5 to 8, the high speed rocker arms 84 to 87 each have an engagement portion 104 that is engaged with the bottom of the connecting pin 90 projecting from the through hole 88. The engagement portion 104 is preferably a semi-circular or substantially semi-circular cut and the connecting pin 90 is engaged with the cut.

Referring to FIGS. 1 and 6 to 8, the rocker shaft support 52 is provided with a lost-motion spring shaft 106 arranged in parallel or substantially parallel with the camshafts 40 and 42. Four such lost-motion spring shafts 106 are provided corresponding to the four valves 22 and 24. More specifically, the lost-motion spring shafts 106 bridge between the central portion 68 and the end portions 70 and 72. A lost-motion spring 108 is wound around the lost-motion spring shaft 106 and latched on each of the high speed rocker arms 84 to 87 and the connecting portion 74. More specifically, the high speed rocker arms 84 to 87 each have a latch slot 110 cut in a semi-circular or substantially semi-circular shape and one end of the lost-motion spring 108 is latched there. The connecting portion 74 has a latch slot 112 cut in a rectangular or substantially rectangular shape and the other end of the lost motion spring 108 is latched there. Therefore, the high speed rocker arms 84 to 87 are urged toward the high speed cam 41.

With reference to FIG. 1, on the intake side, the axial center of the lost-motion spring shaft 106 is provided outside the range defined by connecting the axial center of the camshaft 40 on the intake side, the axial center of the rocker shaft 48, and the midpoint of the stem end surface 79 of the intake valve 22. On the exhaust side, the axial center of the lost-motion spring shaft 106 is provided outside the range defined by connecting the axial center of the camshaft 42 on the exhaust side, the axial center of the rocker shaft 50 and the midpoint of the stem end surface 79 of the exhaust valve 24.

With reference to FIGS. 1 and 3 to 5, the cam carrier 16 is attached to the cylinder head 14 preferably by bolts 67 and 114, for example. With reference to FIGS. 4 and 5, the lower surfaces 116 of cam bearing portions 44 and 46 are connected to the upper surface 118 of the cylinder head 14. A groove 120 in communication with the hydraulic cylinder 92 is defined at the lower surfaces 116 of the cam bearing portions 44 and 46. The groove 120 defines an oil passage. With reference to FIG. 6, the hydraulic cylinder 92 has an opening 122 in communication with the groove 120. Therefore, oil let out from a hydraulic pump (not shown) comes into the hydraulic cylinder 92 via an OCV (Oil Control Valve) (not shown) from the groove 120 through the opening 122. The groove 120 feeds oil to both sides and push the hydraulic pistons 94 on both sides. More specifically, the groove 120 is shared by the hydraulic pistons 94 on both sides.

The groove 120 is open to the side of the lower surface 116 and therefore it is easier to form the groove 120 rather than a hole. The groove 120 may be arranged at the upper surface 118 of the cylinder head 14 rather than at the lower surface 116 of the cam carrier 16. The groove 120 in this example is preferably straight, but it may be curved. It is easy to form grooves if their curves are complicated.

With reference to FIGS. 1, 4 and 6, the central portion 68 and the end portions 70 and 72 of the rocker shaft support 52 have a projected portion 124 that projects beyond the lower surface 116 of each of the cam bearing portions 44 and 46. The rocker shafts 48 to 51 are attached to the projecting portions 124.

In a high speed state, the OCV on the oil passage is opened to increase the oil pressure in the groove 120 and the hydraulic piston 94 is pushed to the outside. The connecting pins 90 are pushed accordingly and inserted into the through holes 88 of the low speed rocker arms 80 to 83. In this way, the bottoms of the connecting pins 90 are projected from the opposite ends of the through holes 88. The high speed rocker arms 84 to 87 are urged toward the high speed cam 41 by the lost-motion springs 108 and the engagement portions 104 are engaged with the connecting pins 90 projecting from the through holes 88. In this way, the low speed rocker arms 80 to 83 are coupled with the high speed rocker arms 84 to 87. When the high speed rocker arms 84 to 87 are greatly swung according to the high speed cam 41 with a large displacement, the low speed rocker arms 80 to 83 are also widely swung together with the high speed rocker arms 84 to 87. In response, the low speed rocker arms 80 to 83 push the intake or exhaust valves 22 and 24 by the stem end surfaces 79 and the intake or exhaust valves 22 and 24 are widely opened.

On the other hand, in a low speed state, the OCV on the oil passage is closed to decrease the oil pressure in the grooves 120 and the energizing force of the spring 98 pushes the connecting pins 90 back toward the hydraulic cylinder supports 43 and 45. In this way, the hydraulic pistons 94 are pushed into the hydraulic cylinders 92 and the bottoms of the connecting pins 90 are completely retained inside the through holes 88. Therefore, the low speed rocker arms 80 to 83 and the high speed rocker arms 84 to 87 are separated. When the low speed rocker arms 80 to 83 are slightly swung according to the low speed cam 39 with a small displacement, the low speed rocker arms 80 to 83 push the intake or exhaust valves 22 and 24 by the stem end surfaces 79 and the intake or exhaust valves 22 and 24 are narrowly opened. At the time, the high speed rocker arms 84 to 87 are greatly swung according to the high speed cam 41, but the bottoms of the connecting pins 90 do not project from the through holes 88, and therefore the high speed rocker arms 84 to 87 do not push anything (idle movement).

Figure 9:
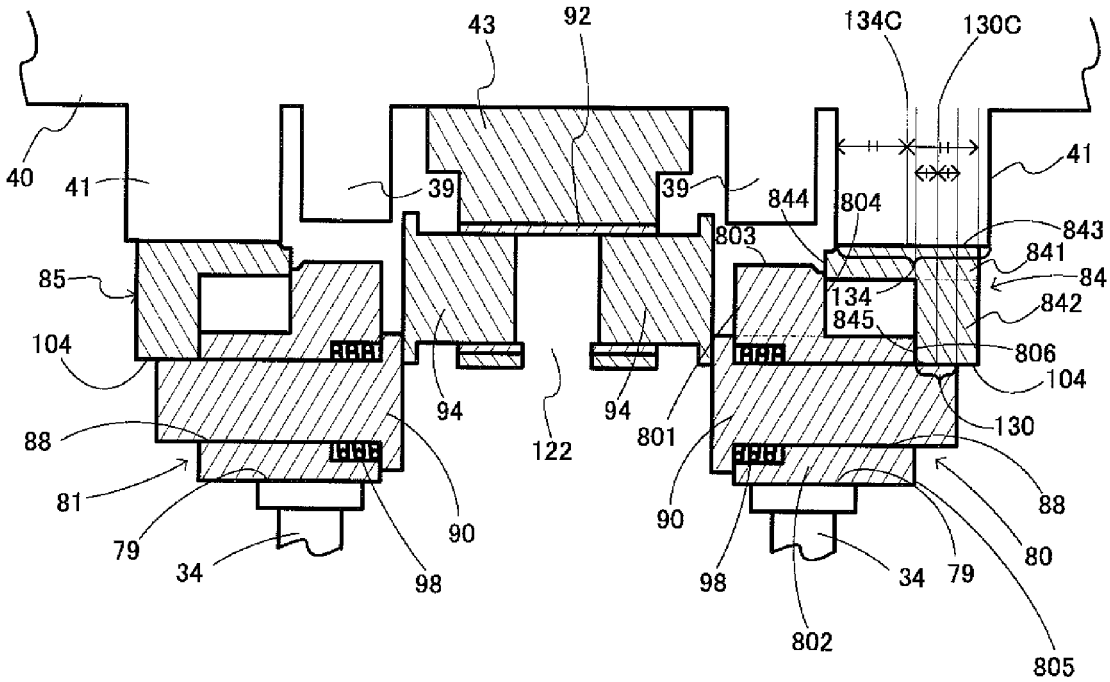
FIG. 9 is a view for illustrating the positional relation between the low speed rocker arm and the high speed rocker arm shown in FIG. 1 and other figures.
Figure 10:
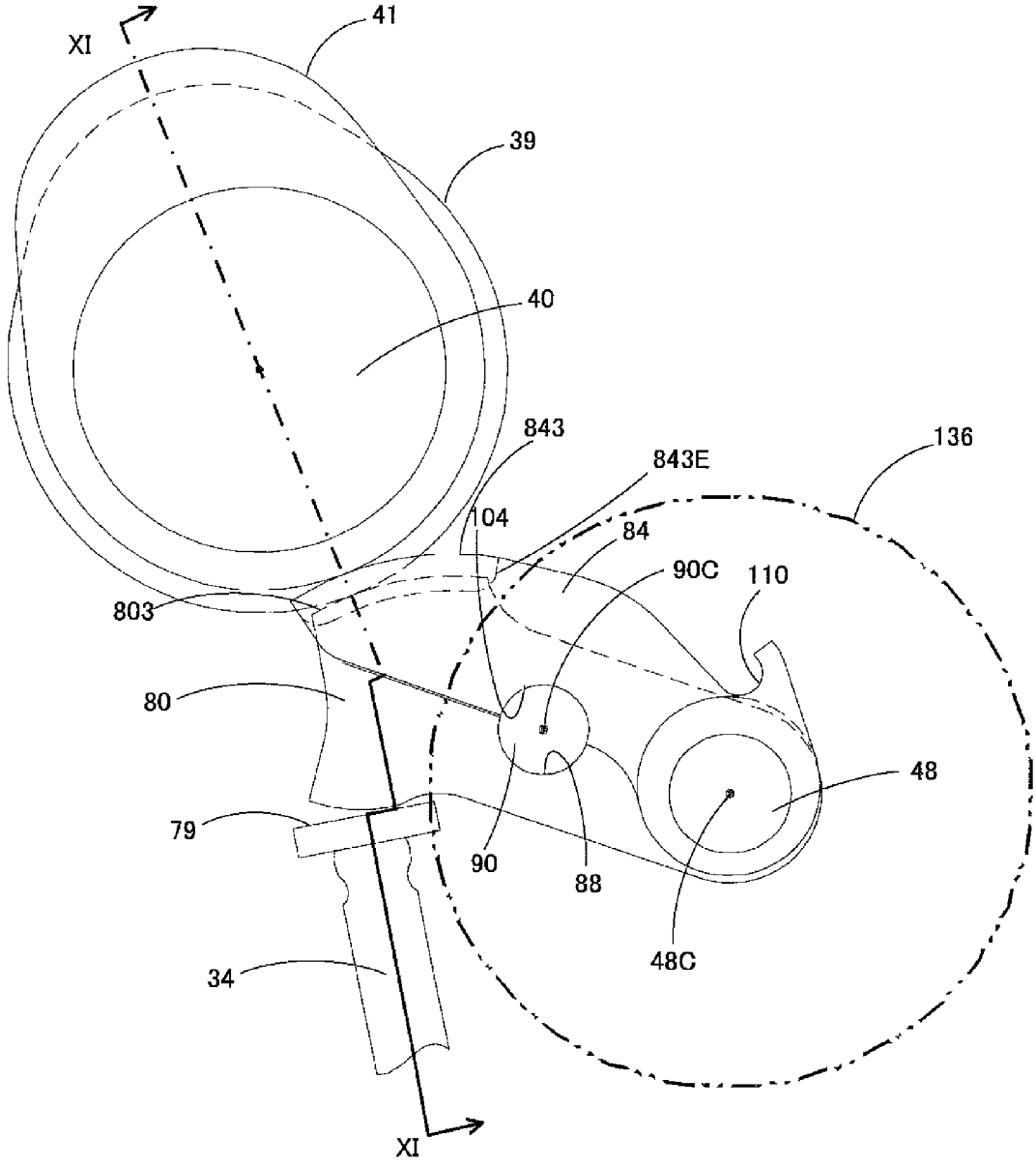
FIG. 10 is a side view of the camshaft, the low speed rocker arm, the high speed rocker arm, the rocker shaft, the connecting pin, and the rod of the intake valve shown in FIG. 1.
Figure 11:
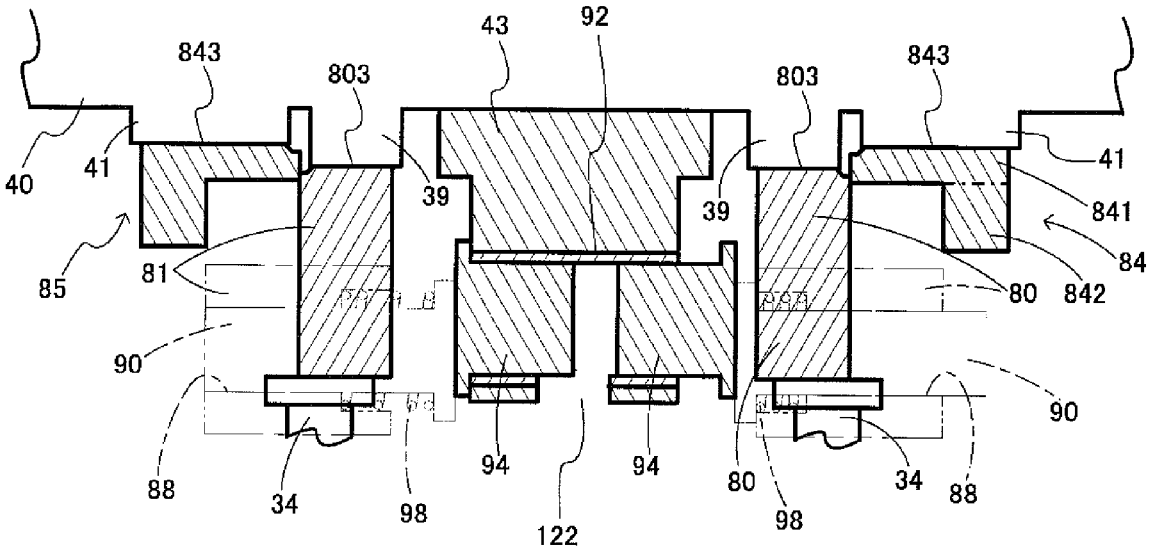
FIG. 11 is a sectional view taken along line XI-XI in FIG. 10.
Figure 12:
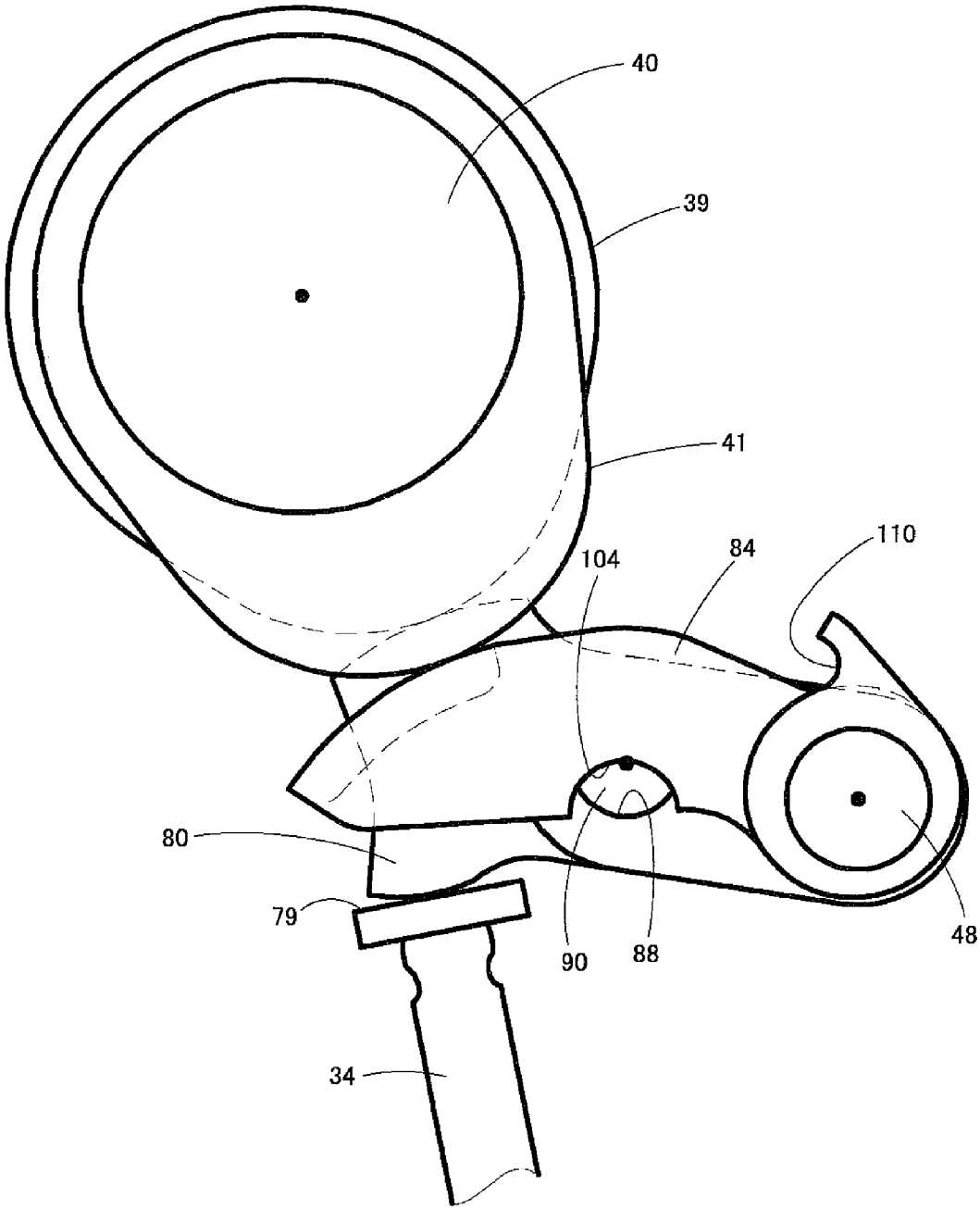
FIG. 12 is a side view of the state in which the low speed rocker arm and the high speed rocker arm shown in FIG. 10 are separated from each other in a low speed state.
Figure 13:
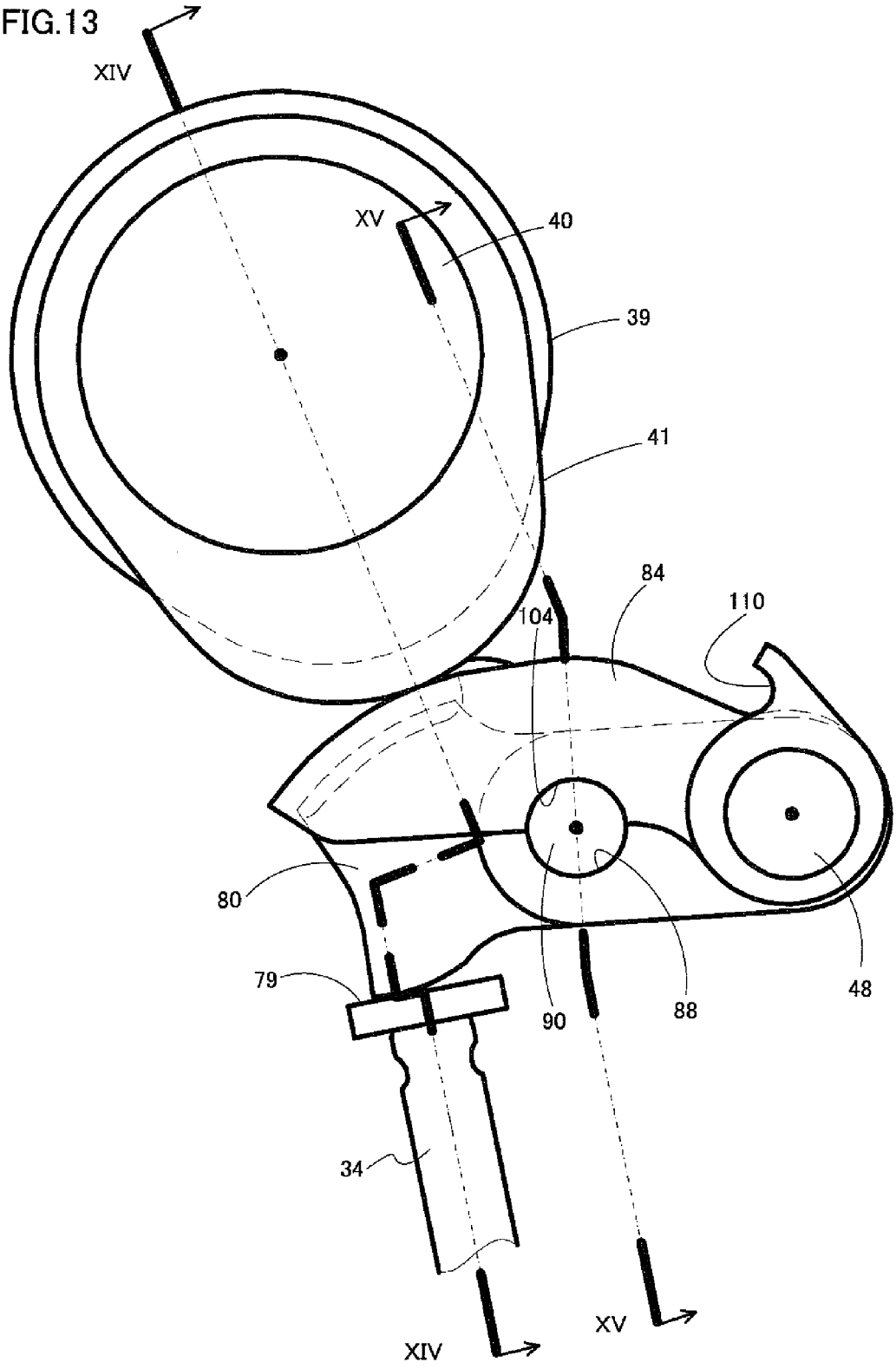
FIG. 13 is a side view of the state in which the low speed rocker arm and the high speed rocker arm shown in FIG. 10 are connected with each other in a high speed state.
Figure 14:
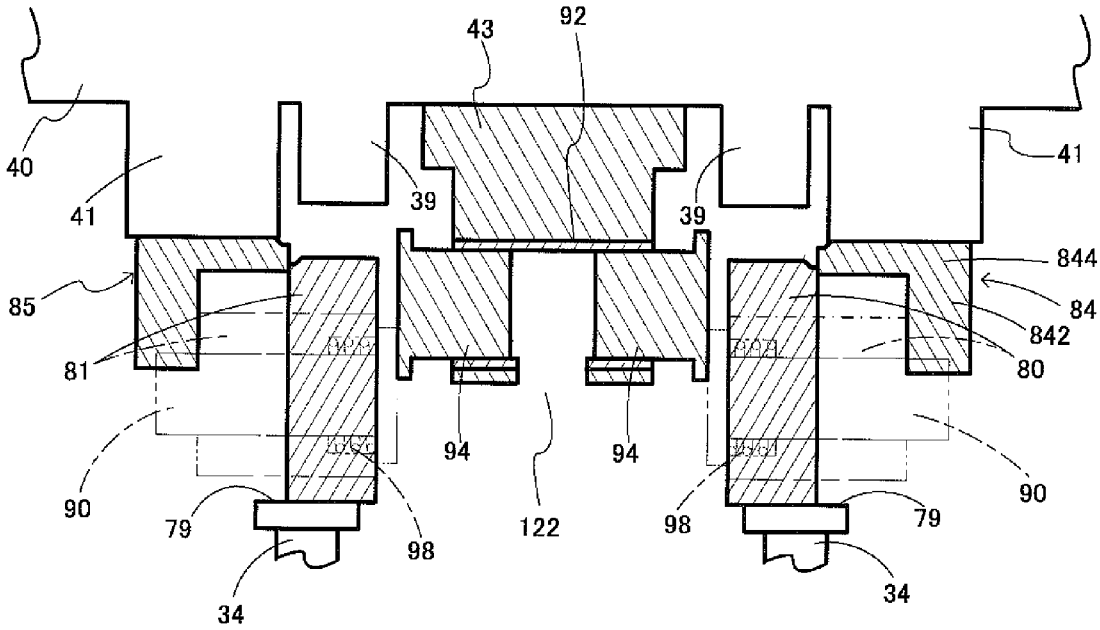
FIG. 14 is a sectional view taken along line XIV-XIV in FIG. 13.
Figure 15:
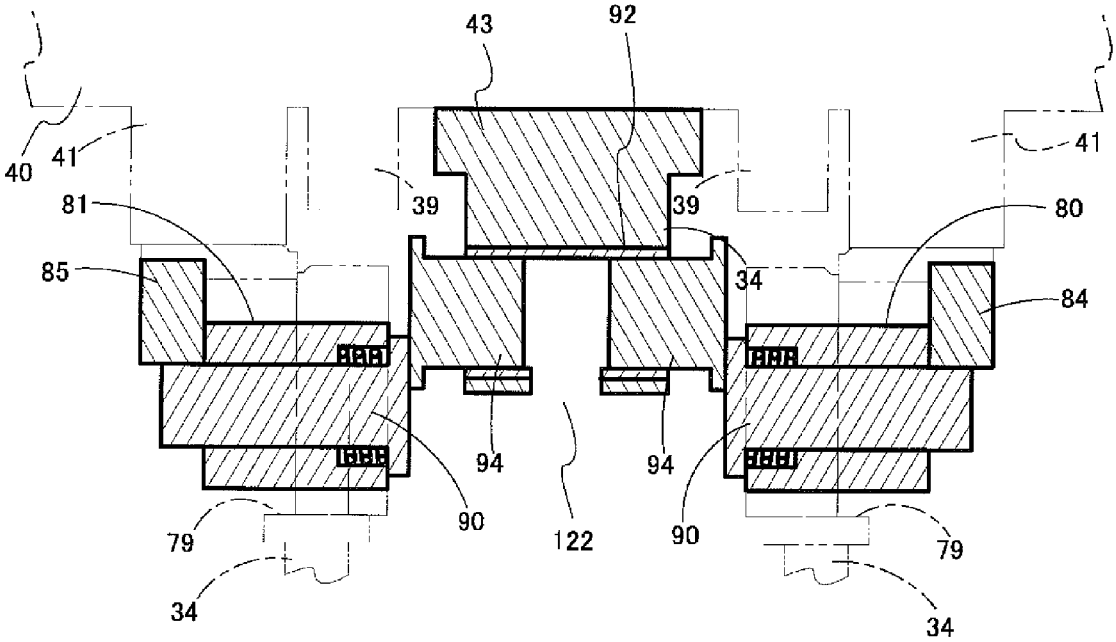
FIG. 15 is a sectional view taken along line XV-XV in FIG. 13.

With reference to FIGS. 9 to 15, the structures of the low speed rocker arms 80 to 83 and the high speed rocker arms 84 to 87 will be described in detail. FIG. 9 is a view for illustrating the positional relation between the low speed rocker arms 80 and 81 and the high speed rocker arms 84 and 85. FIG. 10 is a side view of the camshaft 40, the low speed rocker arm 80, the high speed rocker arm 84, the rocker shaft 48, the connecting pin 90, and the rod 34 of the intake valve shown in FIG. 1. FIG. 11 is a sectional view taken along line XI to XI in FIG. 10. FIG. 12 is a side view of the state in which the low speed rocker arm 80 and the high speed rocker arm 84 shown in FIG. 10 are separated from each other in a low speed state. FIG. 13 is a side view of the state in which the low speed rocker arm 80 and the high speed rocker arm 84 shown in FIG. 10 are coupled in a high speed state. FIG. 14 is a sectional view taken along line XIV to XIV in FIG. 13. FIG. 15 is a sectional view taken along line XV to XV in FIG. 13.

With reference to FIG. 9, the center 130C of the width in the direction of the camshaft 40 of the surface (hereinafter referred to as "engagement surface") 130 where the connecting pin 90 and the engagement portion 104 are in contact with each other is located further than the center 134C of the width in the direction of camshaft 40 of the surface (hereinafter referred to as "cam contact surface") 134 where the high speed cam 41 and the sliding surface 843 of the high speed rocker arm 84 are in contact with each other, from (the rod 34 of) the intake valve 24.

The low speed rocker arm 80 includes a cam receiver 801 and a connecting portion 802. The cam receiver 801 and the connecting portion 802 are integral with each other. The cam receiver 801 has a sliding surface 803 in contact with the low speed cam 39 and a side surface 804 extending perpendicularly or substantially perpendicularly from the end of the sliding surface 803. The width of the connecting portion 802 is wider than the width of the cam receiver 801. The side surface 805 of the connecting portion 802 projects beyond the side surface 804 of the cam receiver 801. The through hole 88 is arranged at the connecting portion 802.

The high speed rocker arm 84 includes a cam receiver 841 and a connecting portion 842. The cam receiver 841 and the connecting portion 842 are integral with each other. The cam receiver 841 has a sliding surface 843 in contact with the high speed cam 41 and a side surface 844 extending perpendicularly or substantially perpendicularly from the end of the sliding surface 843. The side surface 844 of the cam receiver 841 at the high speed rocker arm 84 and the side surface 804 of the cam receiver 801 at the low speed rocker arm 80 are opposed and in contact with each other.

The side surface 806 of the connecting portion 802 and the side surface 845 of the connecting portion 842 are opposed and in contact with each other and provided in the cam contact surface 134 and within the width of the surface in the direction of the camshaft 40.

FIG. 9 is axisymmetrical and the low speed rocker arm 81 and the high speed rocker arm 85 have the structures as described above. The low speed rocker arms 82 and 83 and the high speed rocker arms 86 and 87 shown in FIG. 3 have the structures as described above.

With reference to FIG. 10, the axial center 90C of the connecting pin 90 is provided in a virtual circle 136. The virtual circle 136 is centered on the axial center 48C of the rocker shaft 48. The radius of the virtual circle 136 equals the distance from the axial center 48C of the rocker shaft 48 to the closer end 843E of the sliding surface 843 of the high speed rocker arm 84.

With reference to FIGS. 10 and 11, when the displacements of the low speed cam 39 and the high speed cam 41 are both minimized, the energizing force of the valve spring 26 pushes up the rod 34 of the intake valve, and the low speed rocker arms 80 and 81 are pushed up accordingly, so that the sliding surface 803 and the low speed cam 39 are thus kept in contact. On the other hand, the high speed rocker arms 84 and 85 are pushed up by the energizing force of the lost-motion spring 108, so that the sliding surface 843 and the high speed cam 41 are kept in contact.

In a low speed state, oil pressure is not applied as shown in the left half of FIG. 11, and therefore the connecting pin 90 slides by the energizing force of the spring 98 and pushes the hydraulic piston 94 into the hydraulic cylinder 92. At this time, the connecting pin 90 does not project from the side surface of the low speed rocker arm 81. On the other hand, in a high speed state, oil pressure is applied as shown in the right half of FIG. 11, and therefore the hydraulic piston 94 slides the hydraulic cylinder 92 by the oil pressure. In response, the connecting pin 90 slides against the energizing force of the spring 98 and is pushed into the through hole 88. At the time, the connecting pin 90 projects from the side surface of the low speed rocker arm 80.

With reference to FIG. 12, in a low speed state, when the displacements of the low speed cam 39 and the high speed cam 41 are maximized, the low speed rocker arm 80 is pushed down and the rod 34 of the intake valve is pushed down against the energizing force of the valve spring 26. Similarly, the high speed rocker arm 84 is pushed down against the energizing force of the lost-motion spring 108, but the connecting pin 90 does not project in the low speed state and therefore the high speed rocker arm 84 is not engaged with the connecting pin 90 by the engagement portion 104 and is greatly pushed down.

With reference to FIGS. 13 to 15, in a high speed state, when the displacements of the low speed cam 39 and the high speed cam 41 are maximized, the high speed rocker arm 84 is pushed down, but the connecting pin 90 projects in the high speed state and therefore the high speed rocker arm 84 is engaged to the connecting pin 90 by the engagement portion 104 and thus coupled with the low speed rocker arm 80. Therefore, the low speed rocker arm 80 is strongly pushed down together with the high speed rocker arm 84.

Figure 16:
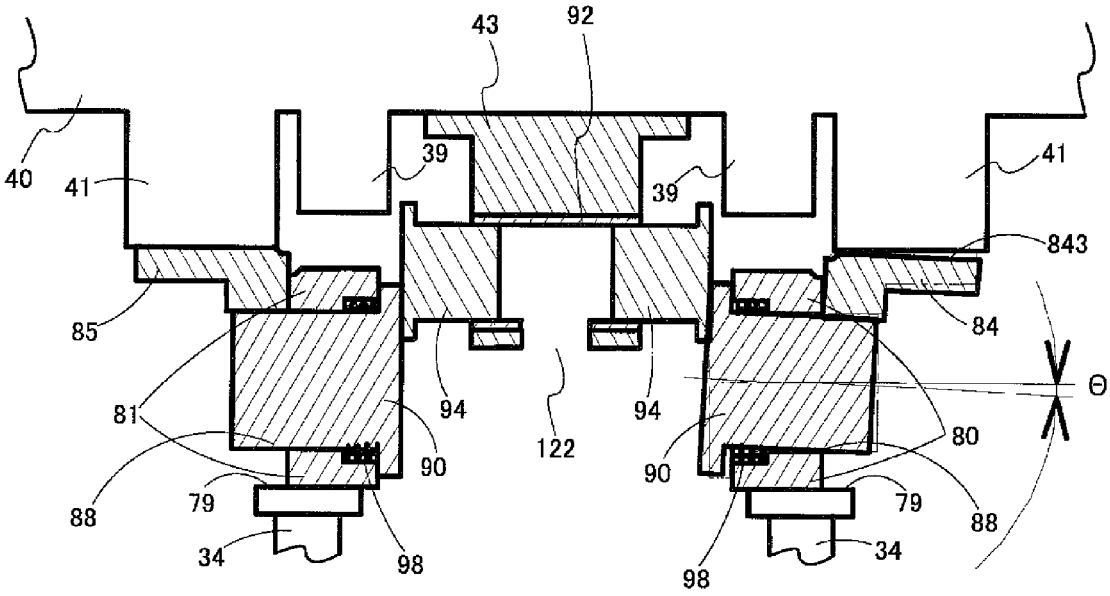
FIG. 16 is a sectional view of a comparative example for use in illustrating a problem to be solved by the variable valve device shown in FIG. 9.

Now, assume that the low speed rocker arms 80 and 81 and the high speed rocker arms 84 and 85 have the structures as shown in FIG. 16. A clearance is necessary between the through hole 88 and the connecting pin 90 in order to allow the connecting pin 90 to slide and to allow for working tolerances. Therefore, when the high speed rocker arms 84 and 85 engage with the connecting pins 90 projecting from the through holes 88 of the low speed rocker arms 80 and 81, and force is applied in the direction perpendicular or substantially perpendicular to the axial direction of the connecting pins 90, the connecting pins 90 are inclined (at $\theta$) within the range of the clearance, and the sliding surface 843 of the high speed rocker arm 84 is inclined accordingly. As a result, the high speed cam 41 and the sliding surface 843 cannot be in a line contact state, and a so-called biased contact is caused, and the high speed cam 41 and the sliding surface 843 end up being unequally worn.

If the connecting pin 90 is extended so that the end surface reaches the side surface (the upper right surface in FIG. 16) of the high speed cam 41 and the entire surface of the high speed cam 41 is received by the connecting pin 90, the inclination can be suppressed. However, the connecting pin 90 should be projected from the through hole 88 for the thickness of the high speed cam 41, and therefore the stroke amount of the connecting pin 90 must be increased. The stroke amount of the hydraulic piston 94 must be increased accordingly, and therefore the width of the hydraulic cylinder support 43 is increased.

If the width of the low speed rocker arm 80 is widened and the through hole 88 is extended, the inclination may be presented and minimized. If however the width of the low speed rocker arm 80 is increased to the side of the high speed rocker arm 84, the offset amount between the high speed cam 41 and the rod 34 of the intake valve is increased, so that the bending moment around the stem end surface 79 by the pushing force by the high speed cam 41 increases. Conversely, if the width of the low speed rocker arm 80 is widened to the side of the bore center, the width of the hydraulic cylinder support 43 is reduced. This makes it difficult to provide the hydraulic cylinders 92 and the hydraulic pistons 94 in an engine with a small valve pitch.

In contrast, according to a preferred embodiment of the present invention shown in FIG. 9, if the high speed rocker arm 84 engages with the connecting pin 90 that projects from the through hole 88, and the connecting pin 90 is slightly inclined, the position where the high speed cam 41 pushes the high speed rocker arm 84 (the center 134C of the width of the cam contact surface 134 in the direction of the camshaft 40) is closer to the low speed rocker arm 80 than the position where the high speed rocker arm 84 pushes the connecting pin 90 (the center 130C of the width of the engagement surface 130 in the direction of the camshaft 40), so that the high speed rocker arm 84 is less likely to be inclined in the same direction as the connecting pin 90. As a result, the inclination of the sliding surface 843 of the high speed rocker arm 84 is prevented.

The connecting portion 802 of the low speed rocker arm 80 has a width wider than that of the cam receiver 801 and the through hole 88 that is longer than that shown in FIG. 16 is arranged at the connecting portion 802, so that the connecting pin 90 is less likely to be inclined if the high speed rocker arm 84 engages with the connecting pin 90 projecting from the through hole 88. In addition, only the connecting portion 802 of the low speed rocker arm 80 is projected toward the high speed rocker arm 84 and the high speed rocker arm 84 is recessed to avoid the projected connecting portion 802, and the high speed rocker arm 84 can be swung so that it does not interfere with the projected connecting portion 802 of the low speed rocker arm 80.

Furthermore, as shown in FIG. 10, the axial center 90C of the connecting pin 90 is provided in the virtual circle 136 centered on the axial center 48C of the rocker shaft 48 and having a radius equal to or substantially equal to the distance from the axial center 48C of the rocker shaft 48 to the closer end 843E of the sliding surface 843 of the high speed rocker arm 84. Therefore, when the connecting pin 90 is stored inside the through hole 88, the connecting portion 802 of the low speed rocker arm 80 is less likely to interfere and the high speed rocker arm 84 can be greatly swung.

Figure 17:
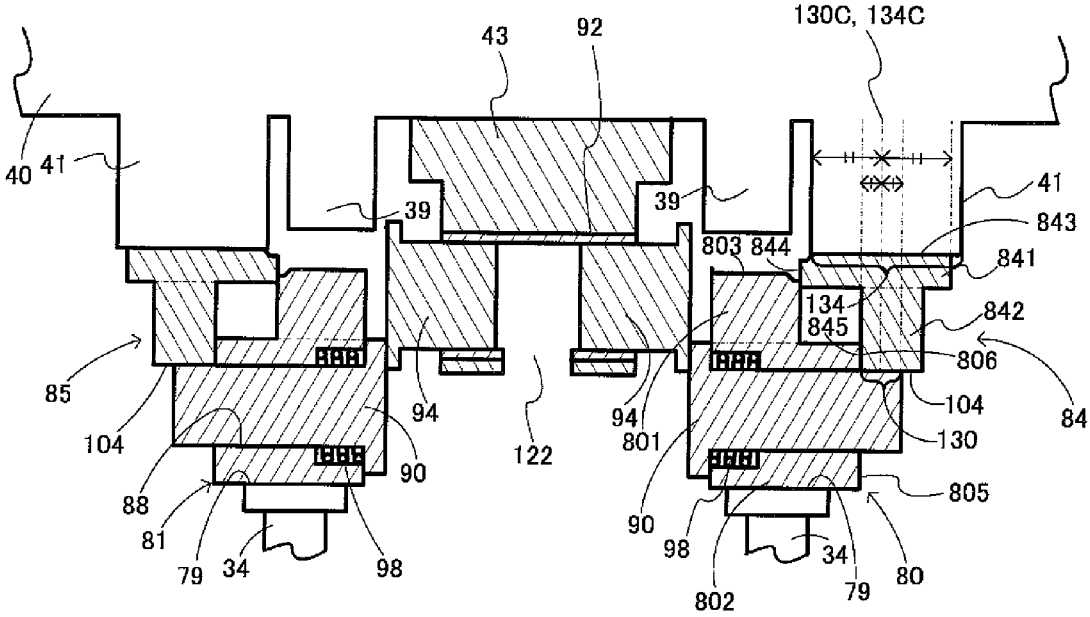
FIG. 17 is a sectional view of a variable valve device according to another preferred embodiment of the present invention.

As shown in FIG. 17, the center 130C of the width of the engagement surface 130 in the direction of the cam shaft 40 may match the center 134C of the width of the cam contact surface 134 in the direction of the camshaft 40.

Preferred embodiments of the present invention are applicable not only to the DOHC engines as described above but also to SOHC (Single Over Head Camshaft) engines.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A variable valve device arranged to switch a lift degree of a valve between a low speed state and a high speed state, the variable valve device comprising:

a low speed rocker arm including a through hole arranged parallel or substantially parallel to a rocker shaft, swingably supported by the rocker shaft, and swingable according to a lower speed cam of a camshaft to push a stem end surface of the valve;

a connecting pin slidably inserted into the through hole;

an actuator arranged to reciprocate the connecting pin in the through hole; and a high speed rocker arm including an engagement portion engaged with the connecting pin projecting from the through hole, swingably supported by the rocker shaft, provided adjacent to the low speed rocker arm, and swingable according to a high speed cam of the camshaft; wherein a first center of a width in a direction of the cam shaft of a surface where the connecting pin and the engagement portion are in contact with each other matches a second center of a width in a direction of the camshaft of a surface where the high speed cam and a sliding surface of the high speed rocker arm are in contact with each other, or is located further away from a center of the valve than the second center of the width; and the connecting is in constant engagement with the through hole of the low speed rocker arm.

2. A variable valve device arranged to switch a lift degree of a valve between a low speed state and a high speed state, the variable valve device comprising:

a low speed rocker arm including a through hole arranged parallel or substantially parallel to a rocker shaft, swingably supported by the rocker shaft, and swingable according to a lower speed cam of a camshaft to push a stem end surface of the valve;

a connecting in slidably inserted into the through hole;

an actuator arranged to reciprocate the connecting pin in the through hole; and a high speed rocker arm including an engagement portion engaged with the connecting in projecting from the through hole, swingably supported by the rocker shaft, provided adjacent to the low speed rocker arm, and swingable according to a high speed cam of the camshaft; wherein a first center of a width in a direction of the cam shaft of a surface where the connecting in and the engagement portion are in contact with each other matches a second center of a width in a direction of the camshaft of a surface where the high speed cam and a sliding surface of the high speed rocker arm are in contact with each other or is located further than the second center from the valve; and the low speed rocker arm further comprises:

a first cam receiver having a sliding surface in contact with the low speed cam and a side surface extending perpendicularly or substantially perpendicularly from an end of the sliding surface; and a first connecting portion integral with the first cam receiver, having a width wider than that of the first cam receiver, and including a side surface projecting beyond a side surface of the first cam receiver, the through hole being arranged at the first connecting portion; wherein the high speed rocker arm further comprises:

a second cam receiver having a sliding surface in contact with the high speed cam and a side surface extending perpendicularly or substantially perpendicularly from an end of the sliding surface and opposed to the side surface of the first cam receiver; and a second connecting portion integral with the second cam receiver and having a side surface opposed to the side surface of the first connecting portion, the engagement portion being arranged at the second connecting portion; and the side surfaces of the first and second connecting portions are provided in a surface where the high speed cam and the sliding surface of the high speed rocker arm are in contact with each other and are within the width of the surface in the direction of the camshaft.

3. The variable valve device according to claim 2, wherein an axial center of the connecting pin is provided in a virtual circle centered on an axial center of the rocker shaft and having a radius equal to or substantially equal to a distance from the axial center of the rocker shaft to a closer end of the sliding surface of the high speed rocker arm.

4. A variable valve device arranged to switch a lift degree of a valve between a low speed state and a high speed state, the variable valve device comprising:

a low speed rocker arm including a through hole arranged parallel or substantially parallel to a rocker shaft, swingably supported by the rocker shaft, and swingable according to a lower speed cam of a camshaft to push a stem end surface of the valve;

a connecting pin slidably inserted into the through hole;

an actuator reciprocating the connecting pin in the through hole; and a high speed rocker arm including an engagement portion engaged with the connecting pin projecting from the through hole, swingably supported by the rocker shaft, provided adjacent to the low speed rocker arm, and swingable according to the high speed cam of the camshaft;

the low speed rocker arm further comprising:

a first cam receiver having a sliding surface in contact with the low speed cam and a side surface extending perpendicularly or substantially perpendicularly from an end of the sliding surface; and a first connecting portion integral with the first cam receiver, having a width wider than that of the first cam receiver, and including a side surface projecting beyond a side surface of the first cam receiver, the through hole being arranged at the first connecting portion; and the high speed rocker arm further comprising:

a second cam receiver having a sliding surface in contact with the high speed cam and a side surface extending perpendicularly or substantially perpendicularly from an end of the sliding surface and opposed to the side surface of the first cam receiver; and a second connecting portion integral with the second cam receiver and having a side surface opposed to the side surface of the first connecting portion, the engagement portion being arranged at the second connecting portion; wherein the side surfaces of the first and second connecting portions are provided in a surface where the high speed cam and the sliding surface of the high speed rocker arm are in contact with each other and within the width of the surface in the direction of the camshaft.

5. The variable valve device according to claim 4, wherein an axial center of the connecting pin is provided in a virtual circle centered on an axial center of the rocker shaft and having a radius equal to or substantially equal to a distance from the axial center of the rocker shaft to a closer end of the sliding surface of the high speed rocker arm.

* * * * *